US006971318B2

(12) United States Patent
Coakley

(10) Patent No.: US 6,971,318 B2
(45) Date of Patent: Dec. 6, 2005

(54) PASSIVE MONORAIL SWITCH FOR A BOX SHAPED TRACK

(76) Inventor: David B. Coakley, 5724 Cannon La., Alexandria, VA (US) 22303

( * ) Notice: Subject to any disclaimer, the term of this patent is extended or adjusted under 35 U.S.C. 154(b) by 20 days.

(21) Appl. No.: 10/833,012

(22) Filed: Apr. 28, 2004

(65) Prior Publication Data

US 2005/0241525 A1 Nov. 3, 2005

(51) Int. Cl.[7] ..... E01B 25/00
(52) U.S. Cl. ..... 104/130.07
(58) Field of Search ..... 104/105, 130.1, 104/96, 118, 119, 130.07; 105/141, 144

(56) References Cited

U.S. PATENT DOCUMENTS

| | | | | |
|---|---|---|---|---|
| 3,225,704 A | | 12/1965 | Gilvar et al. | |
| 3,628,462 A | | 12/1971 | Holt | |
| 3,635,166 A | | 1/1972 | Peterson | |
| 3,640,227 A | * | 2/1972 | Webb | 104/130.04 |
| 3,760,740 A | | 9/1973 | Jacobs, Jr. et al. | |
| 3,828,691 A | | 8/1974 | Purath | |
| 3,830,163 A | | 8/1974 | Wright et al. | |
| 3,845,723 A | | 11/1974 | Jacobs Jr. et al. | |
| 4,000,700 A | | 1/1977 | Hannover et al. | |
| 4,522,128 A | | 6/1985 | Anderson | |
| 4,658,731 A | | 4/1987 | Schumann | |
| 4,671,185 A | | 6/1987 | Anderson et al. | |
| 5,590,605 A | | 1/1997 | Salter et al. | |
| 5,778,796 A | | 7/1998 | Kim | |
| 6,095,054 A | * | 8/2000 | Kawano et al. | 104/139 |
| 6,220,173 B1 | | 4/2001 | Sauerwein | |
| 6,393,993 B1 | * | 5/2002 | Reese | 104/130.01 |
| 6,564,722 B1 | * | 5/2003 | Kurosawa et al. | 104/155 |

FOREIGN PATENT DOCUMENTS

JP 54-149117 * 11/1979

* cited by examiner

*Primary Examiner*—Mark T. Le
(74) *Attorney, Agent, or Firm*—Lawrence E. Laubscher, Sr.; Lawrence E. Laubscher, Jr.

(57) ABSTRACT

A monorail switching arrangement is disclosed for switching the travel of a vehicle to either a continued-travel monorail section or a change-of-direction switched-travel monorail section, characterized by the provision of a plurality of vertically displaceable horizontal switching wheels arranged on opposite sides of the first monorail section for displacement between upper and lower positions in alternate engagement with pairs of continued-travel and switched-travel control tracks mounted on opposite sides of the monorail, respectively. In one embodiment, the switching wheels are vertically displaceable relative to the chassis, and in a second embodiment, the chassis and the switching wheels are vertically displaceable as a unit relative to the vehicle support wheels and the monorail.

17 Claims, 11 Drawing Sheets

FIG. 2
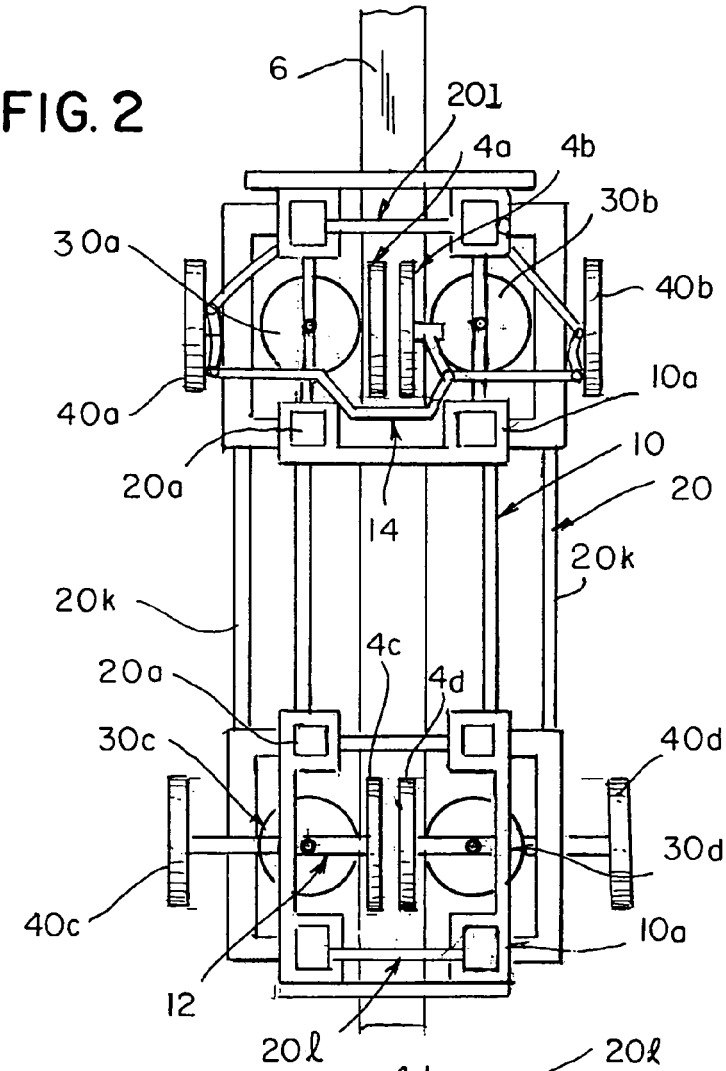
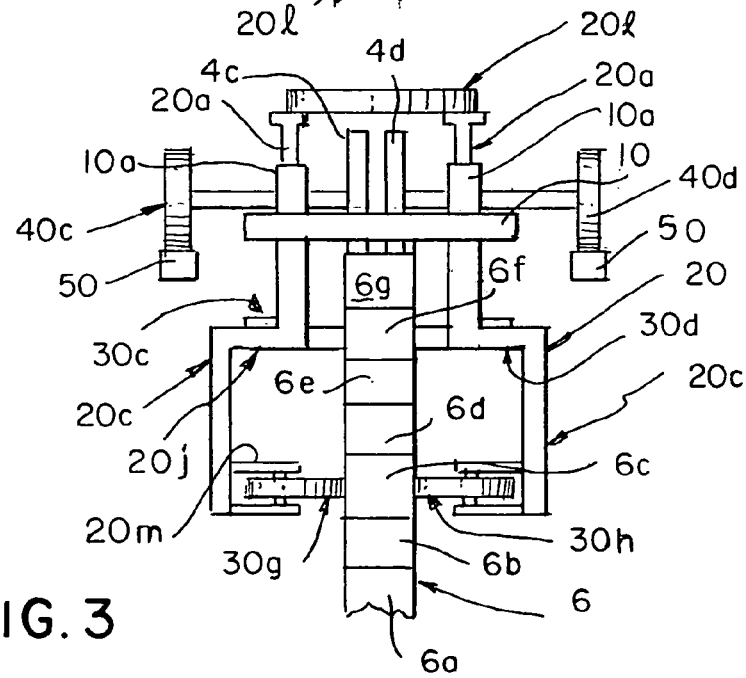
FIG. 3

PASSIVE MONORAIL SWITCH FOR A BOX SHAPED TRACK

FIELD OF THE INVENTION

A monorail switching system for switching a vehicle supported by support wheels for travel along the upper surface of a monorail having a rectangular cross-sectional configuration, characterized by the provision on a vertical side wall of the monorail at least one pair of horizontally-extending vertically-arranged continued-travel and switched-travel control tracks, respectively, in combination with vertically adjustable switching wheels carried by the vehicle for selectively engaging the control tracks to effect either continued travel or switched travel of the vehicle.

BACKGROUND OF THE INVENTION

Brief Description of the Prior Art

It is well known in the monorail transportation art to provide active and passive arrangements for switching the direction of travel of a vehicle from one destination to another, as evidenced by the prior patents to Gilvar, et al., U.S. Pat. No. 3,225,704, Webb U.S. Pat. No. 3,628,462, Holt U.S. Pat. No. 3,628,462, Purath U.S. Pat. No. 3,828,691, Hannover, et al., U.S. Pat. No. 4,000,700, Anderson U.S. Pat. No. 4,671,185, and Reese U.S. Pat. No. 6,393,993, among others.

In general, the passive type switches apply to U-shaped tracks for monorail cars that either ride on top of the track or are suspended beneath it. The void between the legs of the U is taken by the suspension and switching means of the car which uses wheels, magnetic levitation, or other technology to thrust along the track, resist gravity and steer to one side when a switch is entered.

Alternatively, monorails that use box-shaped tracks and whose cars ride atop the track have previously included switch means having moving or energized track parts to ensure safe switching between track directions. This is because the typical car suspension means use an inverted U-shaped conglomeration of wheels and struts that reaches around both sides of the monorail track to hold the car atop the track. The moving switch parts allow the legs of the inverted U to pass through the path of the track not taken.

The present invention was developed to provide a switching arrangement for box-shaped tracks having no moving or energized parts but which allows the disclosed car with an inverted U-shaped conglomeration of wheels and struts to negotiate the switch at various speeds. The car determines which of the diverging paths to take at the switch by the vertical position or elevation of switching wheels rolling on the side of the track. This new steering concept for monorail systems affords positive switching operation in an inexpensive, durable manner.

SUMMARY OF THE INVENTION

Accordingly, a primary object of the present invention is to provide a monorail switching arrangement wherein switching wheels carried by a vehicle traveling along the top surface of a monorail engage control tracks mounted on the side of the monorail for controlling the switching direction between two divergent tracks. One horizontal control track is a continued-travel track, and a second horizontal track vertically arranged relative to the first track comprises a switching track, the switching wheels being vertically adjustable for engagement with a selected control track, thereby to control the destination of the vehicle.

According to one embodiment of the invention, the switching wheels are vertically displaceable relative to the vehicle chassis and to the horizontal continued-travel and switched-travel control tracks mounted on one side wall of the monorail. According to a second embodiment, the switching wheels are fixed relative to the vehicle, and the vehicle and the switching wheels are vertically displaceable as a unit relative to the vehicle support wheels and to the switching control tracks.

According to another object of the invention, lateral stabilizing rails may be provided adjacent the monorail for engagement by wing wheels on the vehicle, thereby to stabilize the same during travel along the track. In one embodiment, the wing wheels are spaced laterally outwardly from the vehicle, and in a second embodiment, the wing wheels are mounted on the top of the vehicle. For lower speed monorail systems, these stabilizing rails may be eliminated.

DESCRIPTION OF THE DRAWINGS

Other objects and advantages of the invention will become apparent from a study of the following specification when viewed in the light of the accompanying drawings, in which:

FIGS. 2 and 3 are top plan and end elevation views, respectively, of the switching apparatus of FIG. 1;

DETAILED DESCRIPTION

Figure 1:
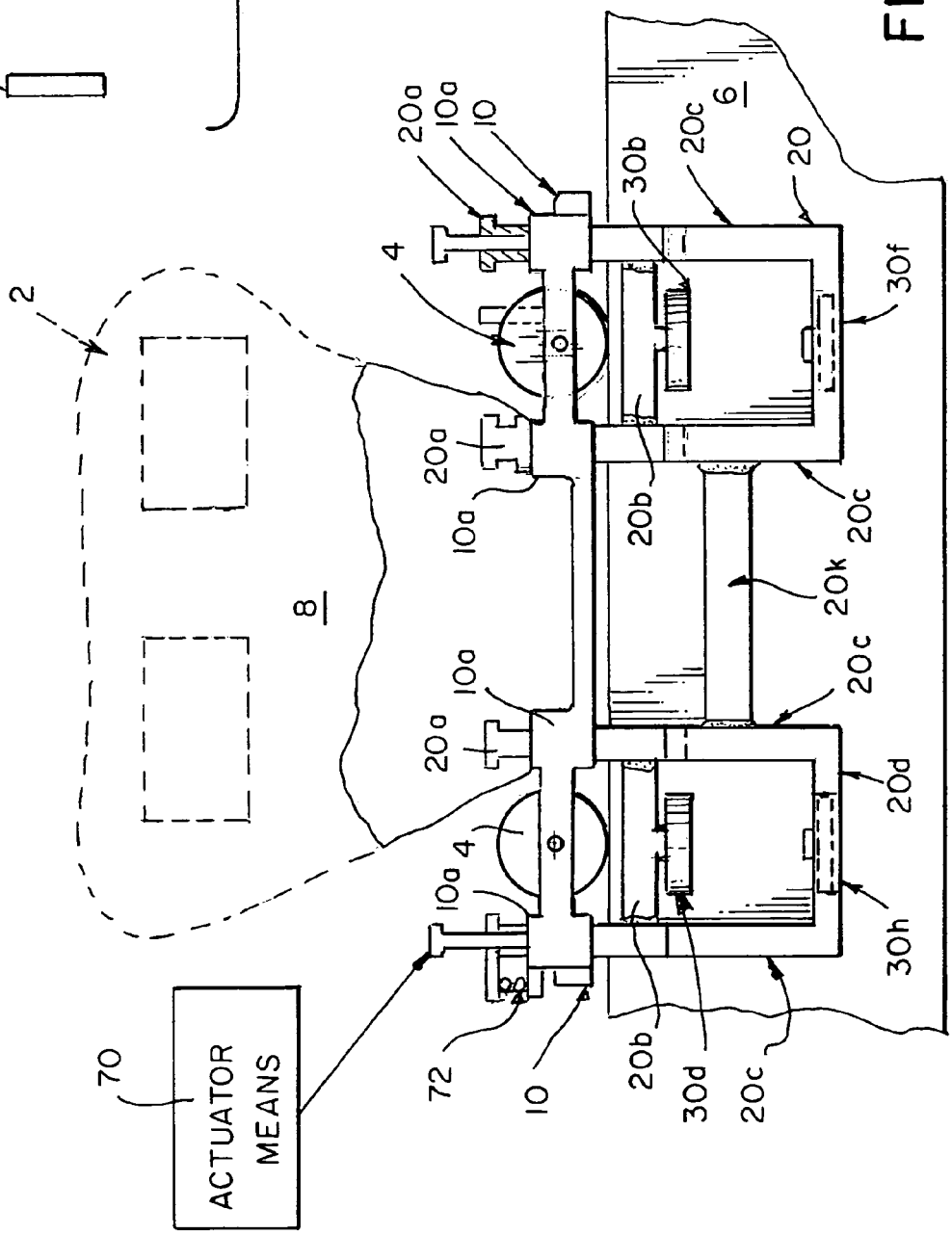
FIG. 1 is a side elevation view of a first embodiment of the monorail switching apparatus of the present invention.
Figure 4:
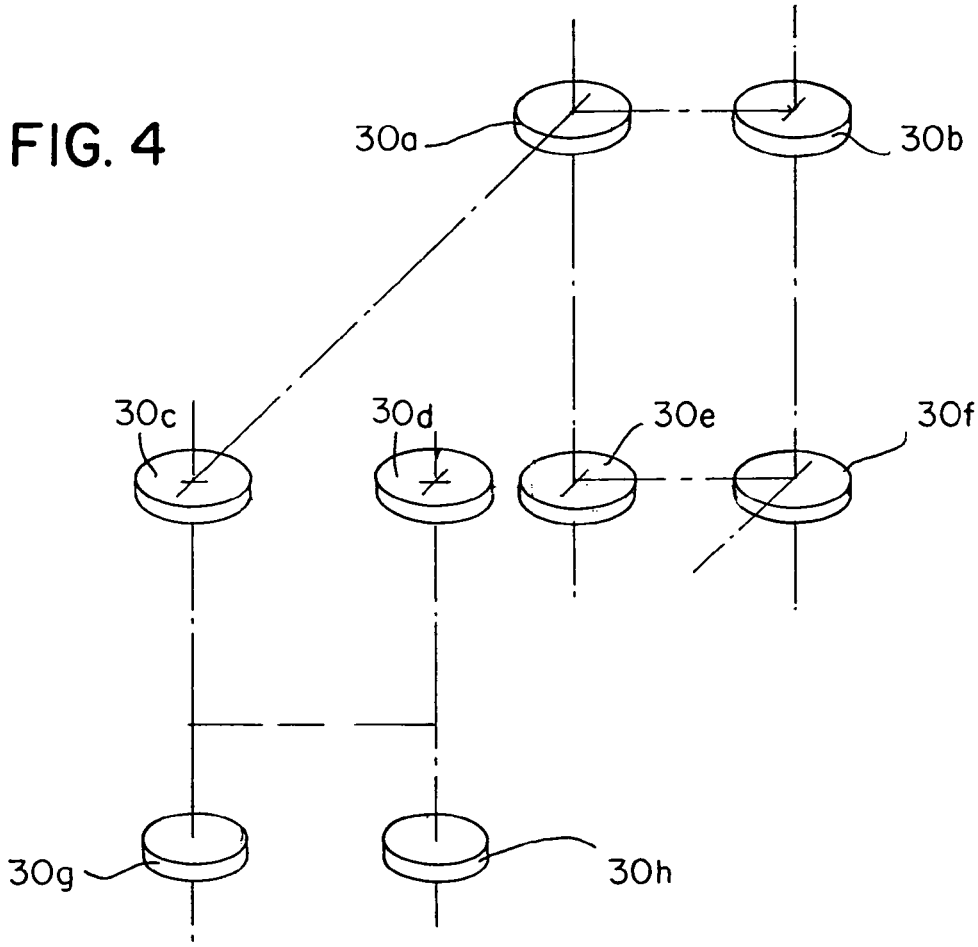
FIGS. 4 and 5 are diagrammatic illustrations of the four pairs of switching wheels of FIG. 1.

Referring first more particularly to FIGS. 1–3, the switching apparatus of the present invention includes a vehicle 2 that is supported by support wheels 4 for travel along the horizontal upper surface of a first monorail section 6. The vehicle includes a body or carriage 8 that is supported by a chassis 10 to which the support wheels 4 are journalled by means of axles 12. As best shown in FIG. 2, a pair of guidable front support wheels 4*a* and 4*b* are supported at the front end of the chassis 10 by a conventional steering arrangement 14, and a pair of rear support wheels 4*c* and 4*d* arranged at the rear end of the chassis 10.

Figure 5:
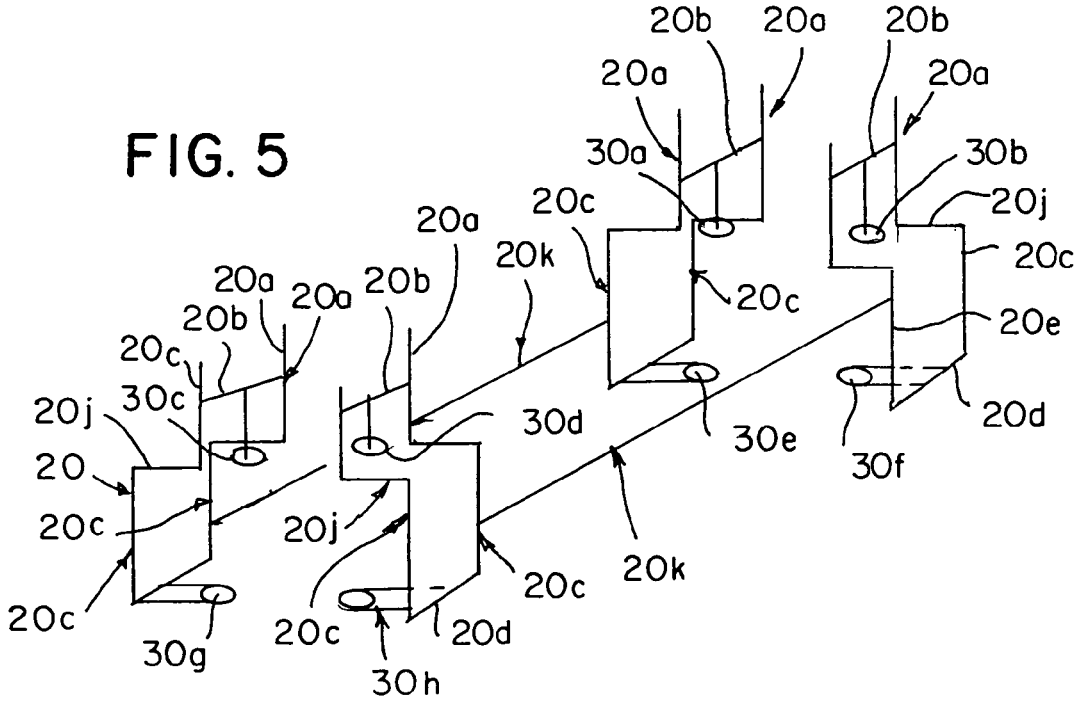

According to a characterizing feature of the invention, a generally rectangular box-shaped switching frame 20 is provided that is vertically displaceable relative to the vehicle chassis 10. More particularly, the switching frame includes upwardly projecting vertical guide portions 20*a* that are slideably received within corresponding bores contained in guide sleeve portions 10*a* of the chassis 10. As shown schematically in FIG. 5, the switching frame 20 includes also upper horizontal arms portions 20*b* that are connected between the pairs of guide portions 20*a*, and horizontal arm portions support the pairs of horizontally arranged upper switching wheels 30*a* and 30*b* at the forward end of the chassis as well as the upper switching wheels 30*c* and 30*d* at the rear end of the chassis. Furthermore, the switching frame 20 includes pairs of lower strut members 20*c* between the lower ends of which are connected to the horizontal stringers 20*d* which in turn by mans of ears 20*m* (FIG. 3) support the lower pairs of switching wheels 30*e*, 30*f*, 30*g*, and 30*h*. As will be described in greater detail below, these upper and lower pairs of switching wheels engage corresponding switching control tracks on the vertical surfaces of the monorail 6. The vertical lower struts 20*c* are offset from the vertical guide extensions 20*a* by the horizontal offset laterally outwardly portions 20*j*. The forward and rear pairs of vertical struts 20*c* are stabilized by the longitudinally extending members 20*k*. If desired, the switching frame 20 includes upper stabilizing members 20*l* connected between the upper ends of the vertical guide struts 20*a*, as shown in FIGS. 2 and 3.

The vehicle may be stabilized against rolling side-to-side movement by means of laterally-spaced wing wheels 40*a*, 40*b*, 40*c*, and 40*d*, that are arranged to engage lateral stabilizing rails 50, as best shown in FIG. 3.

Figures 6, 7, 8, 9:
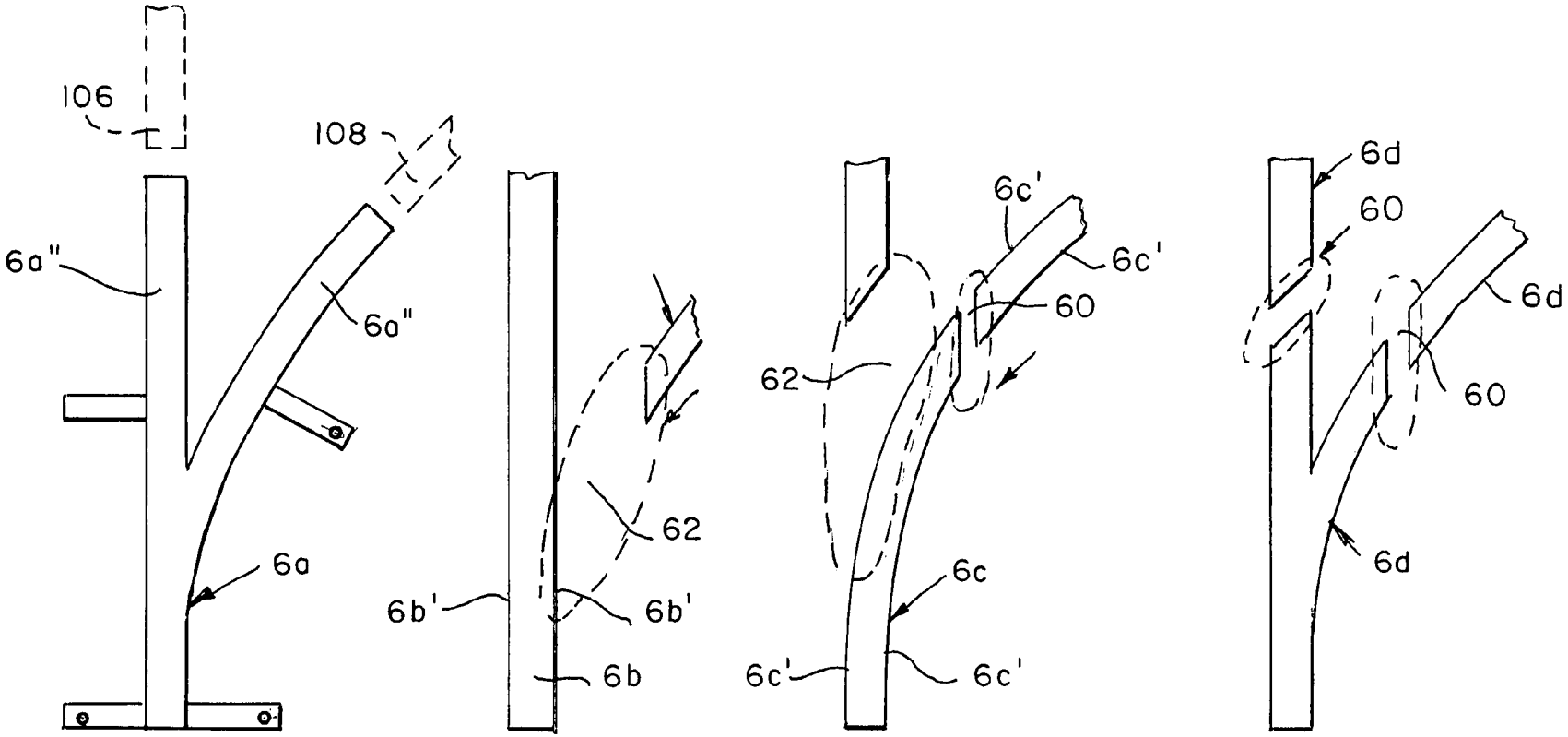
FIGS. 6–12 are diagrammatic illustrations of the successive switching layers of the monorail switch of FIG. 1.

In accordance with the present invention, the monorail 6 is provided on its lateral surfaces with control tracks for alternately effecting either a continued travel of the vehicle on the rail or a switched travel of the vehicle on the rails. To this end, the monorail 6 includes a plurality of stacked layers 6*a*, 6*b*, 6*c*, 6*d*, 6*e*, 6*f*, and 6*g* having the configurations shown in FIGS. 6–12, respectively. More particularly, the lower most monorail layer comprises a support layer 6*a* having a pair of bifurcated leg portions 6*a*' and 6*a*" that extend toward the associated continued travel monorail section 106 and the switched monorail section 108, respectively. The second monorail layer 6*b* (FIG. 7) is a control layer having on each side thereof a lateral surface 6*b*' that defines a continued travel control surface. A wheel gap 62 accommodates passage of the lower switching wheels. The next control layer 6*c* (FIG. 8) has on each side thereof a lateral surface 6*c*' that defines a switching control track that is operable to switch the vehicle to the switched rail 108, as will be described below. Strut gap 60 receives strut 20*c* when the continued travel path is taken.

The fourth layer 6*d* (FIG. 9) of the monorail 6 is a spacer layer that supports a second continued travel layer 6*e* (FIG. 10) having a continued travel control track 6*e*' on each of its lateral surfaces. The next rail layer 6*f* (FIG. 11) is a second switching layer carrying on each of its lateral surfaces 6*f* a switching control track. These control tracks are alternately engaged by the upper and lower switching wheels 30*a*–30*h* when the switching frame 20 is vertically displaced between a first position effecting engagement of the switching wheels with the continued travel control tracks of layers 6*b* and 6*e*, and an elevated second position in which the switching wheels are in engagement with the switching control tracks of the layers 6*c* and 6*f*, respectively. It is to be noted that strut gaps 60 receive struts 20*c* in layers 6*b*–6*e*, while strut gaps 60 in layers 6*f* and 6*g* receive the strut 20*a*. Wheel gaps 62 permit the passage of the switching wheels and lower struts 20*c*. The top layer 6*g* of FIG. 12 has an upper surface that supports the support wheels 4. Similarly, the lateral support rails 50 have upper surfaces that are engaged by the wing wheels 40*a*–40*d*, respectively.

Referring again to FIG. 1, switch actuator means 70 are provided for vertically displacing the switching frame 20 between its lower and upper positions. Coil spring means 72 are provided for counter-balancing the weight of the switching frame 20 and the switching wheels.

Since the sides of the spacer layer 6*d* are not engaged by the switching wheels, this layer may be used to support electrical power cables, communication lines, and the like. The individual layers of the monorail are fixed together to form a rigid structure for supporting the vehicle. The advantage of the top seventh layer 6*g* is that it minimizes the gaps traversed by the support wheels. One disadvantage to this layer is that a vehicle using this layer experiences increased reactions on the side wheels owing to the increased centripetal forces. To reduce these centripetal forces, this layer 6*g* may be caused to be thinner than the other layers.

Figure 13:
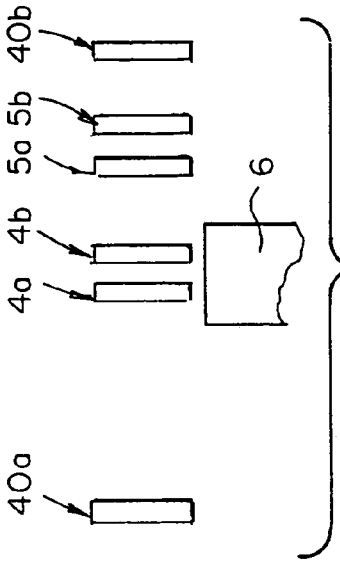
FIG. 13 is a sectional representation of a modified arrangement of the support wheels of FIG. 1 relative to the monorail.
Figure 12:
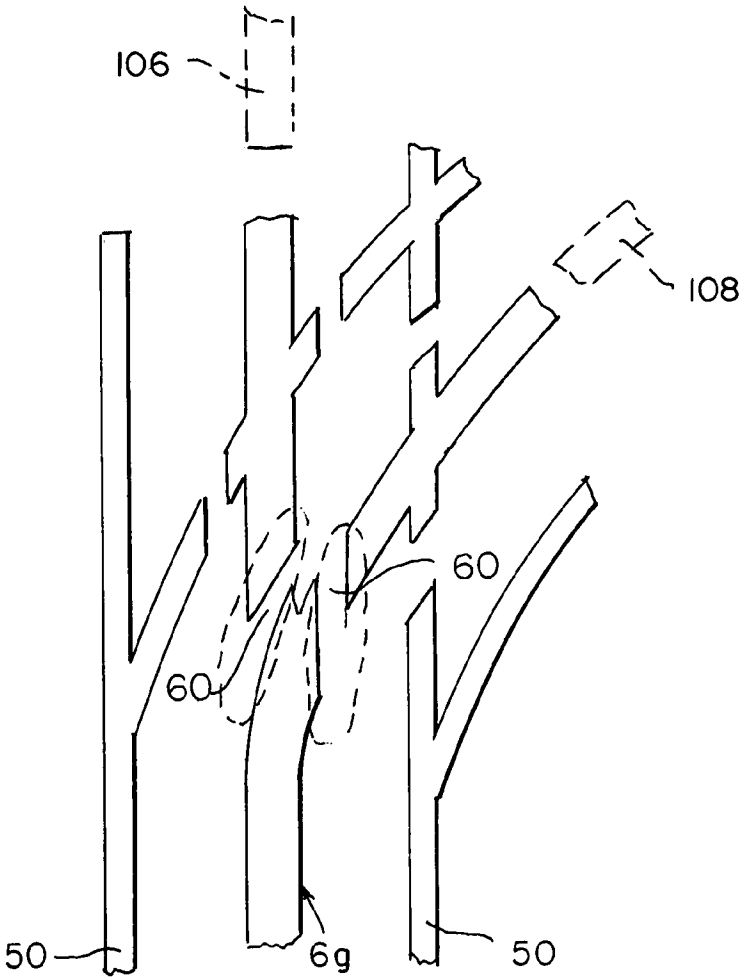
Figure 11:
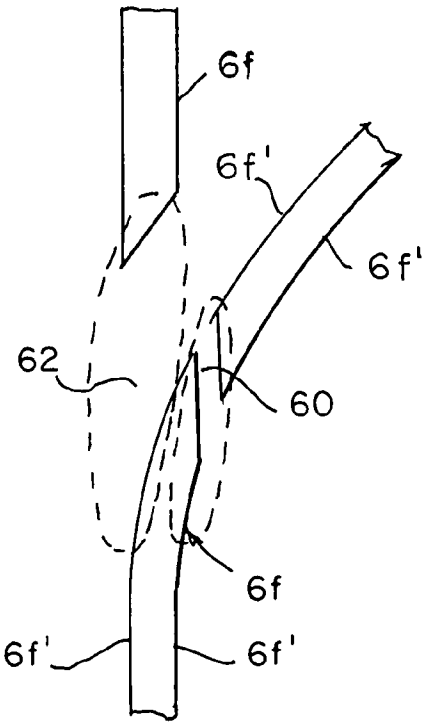
Figure 10:
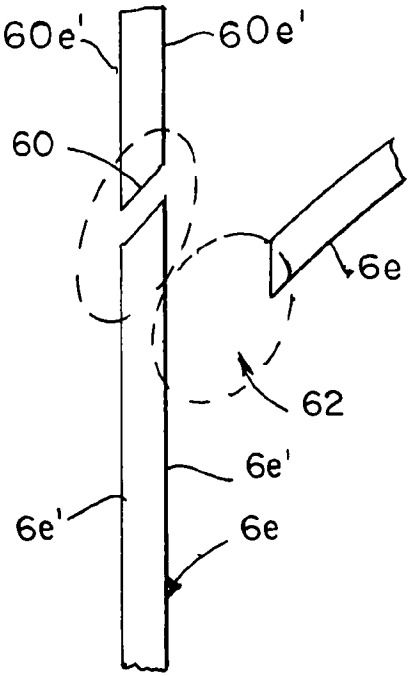
Figure 14:
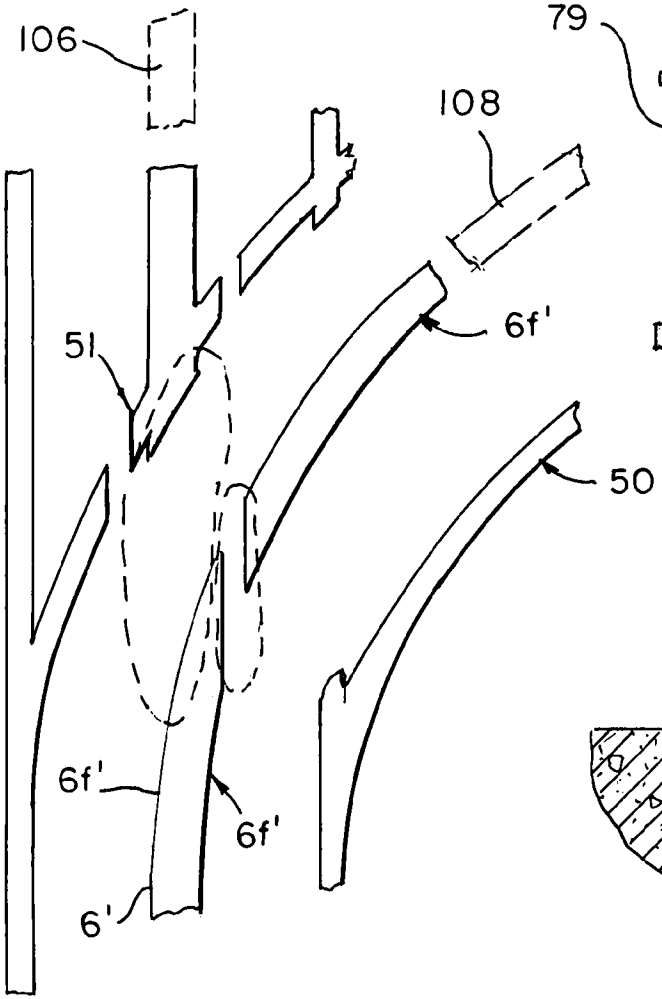
FIG. 14 is a diagrammatic plan view of the top layer of a second monorail embodiment.
Figure 17:
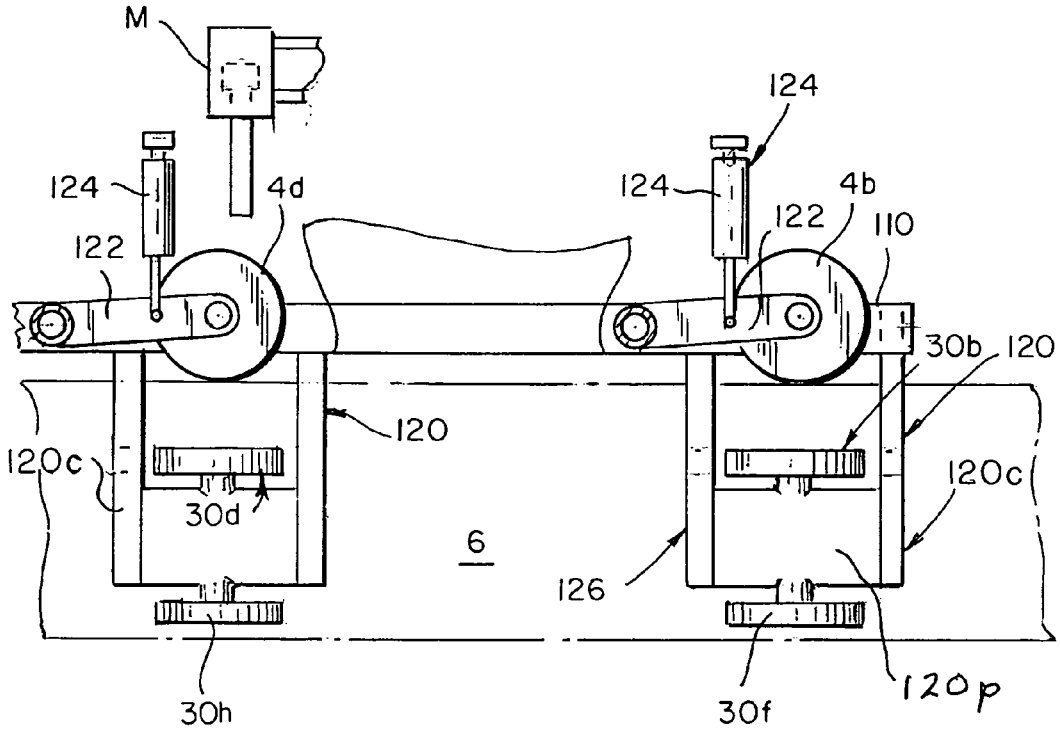
FIG. 17 is a side elevational view of a second embodiment of the invention when in the lowered sensing condition.

As shown in FIG. 13, additional support wheels 5*a*, 5*b* may be provided for supporting the vehicle chassis for travel relative to the monorail 6. These additional wheels are useful in the 6-layer monorail modification of FIG. 14, wherein the top seventh layer 6*g* of FIG. 12 is omitted, and the layer 6*f*' defines the top layer of the monorail. In this case, the wing wheels ride on the rails 50 and 51 during a turn, and the additional support wheels ride on the rail portion 6*f*' during continued or straight travel.

Figure 16:
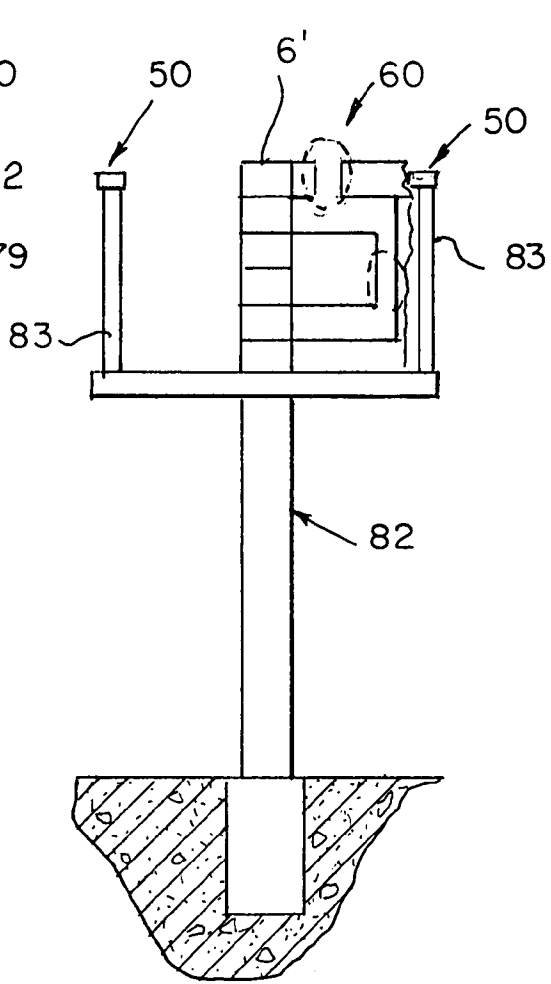
FIGS. 15 and 16 are sectional representations of the monorail stanchion support means of the first and second monorail embodiments, respectively.
Figure 15:
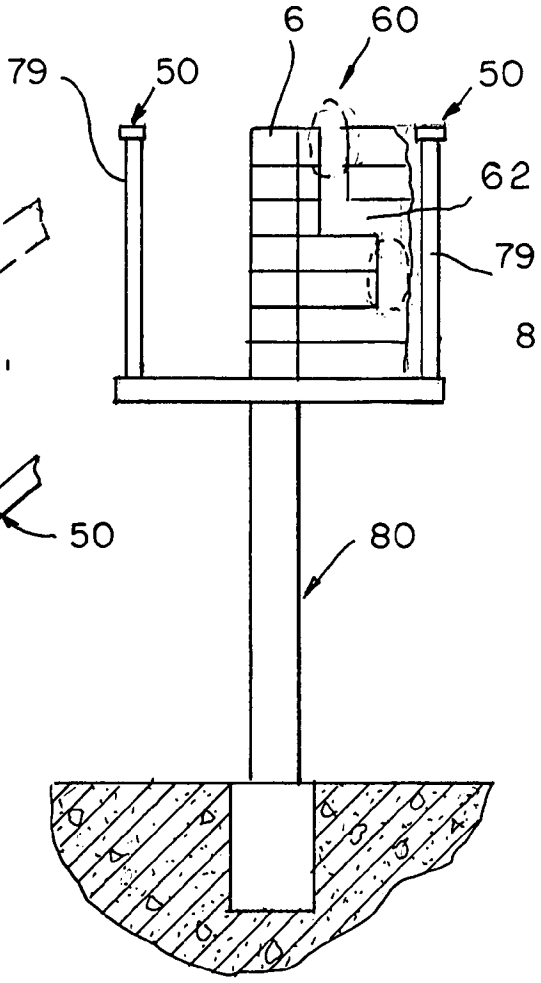

Referring now to FIG. 15, in the illustrated seven-layer monorail embodiment, the lateral stabilizing rails 50 are supported by the vertical supports 79 that extend upwardly from the stanchion 80 that supports the rail 6. In the six-layer embodiment of FIG. 16, the rail 6' is supported by stanchion 82, and with the stabilizing rails 50 being supported by the vertical supports 83.

Figure 18:
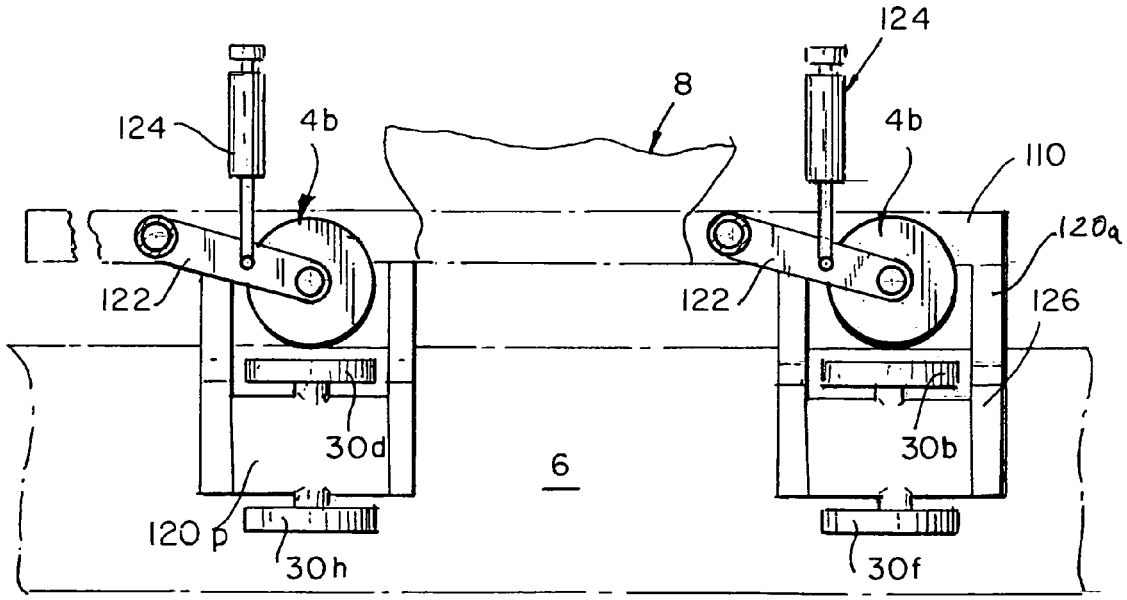
FIG. 18 is a corresponding view of the second embodiment of the invention when in the elevated sensing position.
Figure 19:
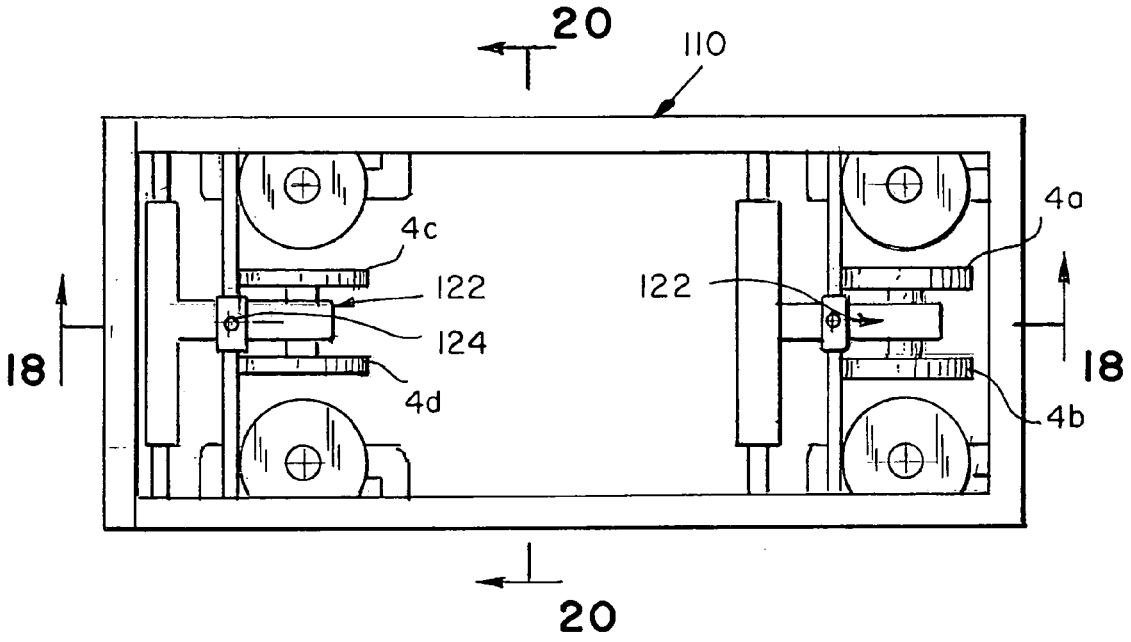
FIG. 19 is a top plan view of the switching apparatus of FIG. 18.
Figure 20:
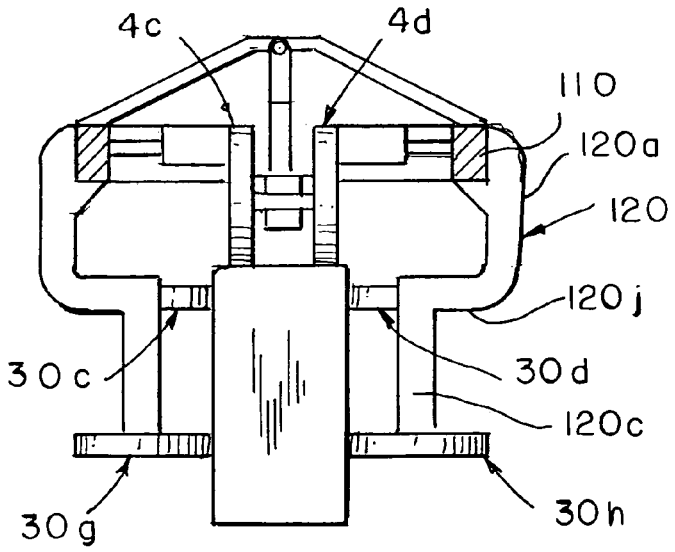
FIG. 20 is a sectional view taken along line 20—20 in FIG. 19.

Referring now to FIGS. 17–20, a second embodiment of the invention is disclosed wherein the switching wheels 30*a*–30*h* are directly connected with the chassis 110 by the vertical support members 120, and the chassis in turn is vertically displaceable relative to the monorail 6 by means of pivot arms 122 that are pivoted at one end to the chassis, and that rotatably support the support wheels 4 at the other end. In this embodiment, jack screw means 124 are provided for pivoting the arms 122, thereby to raise the chassis 110 and the switching wheels 30*a*–30*h* vertically relative to the upper surface of the monorail 6 as shown in FIG. 18. Thus, when the jacks 124 are operated to pivot the pivot arms 122 in the clockwise direction, the chassis 110, the switching wheel carriers 126, and the switching wheels 30*a*–30*h* are all elevated relative to the upper surface of the monorail 6, thereby to effect selective cooperation between the switching wheels 30*a*–30*h* and the control tracks for effecting either continued operation of the vehicle in its initial direction, or switching of the vehicle toward the switched direction, respectively. FIG. 20 illustrates a different arrangement of the vertical struts of FIG. 3, wherein the upper struts are outboard of the lower inboard struts 120*c*, connection being made by the horizontal struts 120;

It is apparent that instead of the use of jack screws 124, the pivot arms 122 may be pivoted upwardly and downwardly by hydraulic piston and motor means M, as well.

Figure 22:
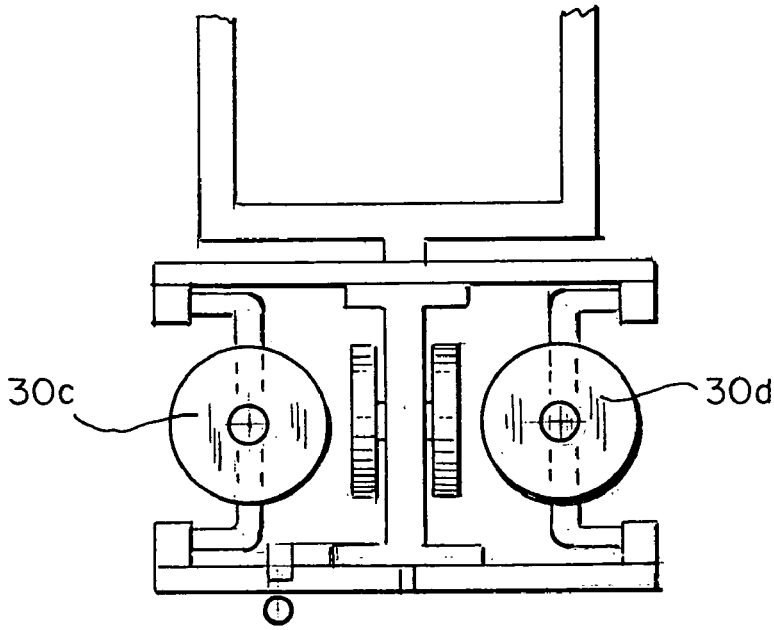
FIGS. 21 and 22 are end and top plan views, respectively, of a modification of the invention of FIG. 3 including a four-arm linkage arrangement.
Figure 21:
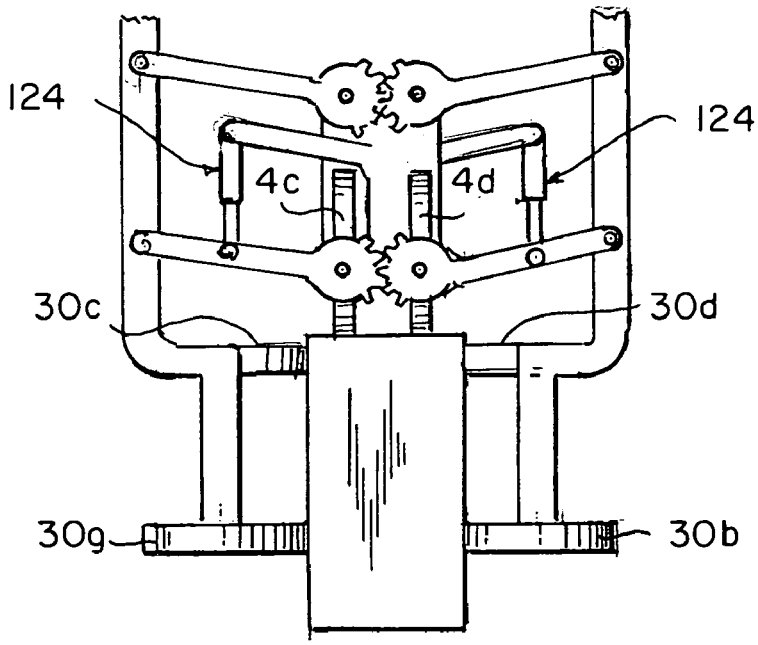

FIGS. 21 and 22 disclose an alternative four-lever mechanism for vertically displacing the chassis and the switching wheels 30*a*–30*h* upwardly and downwardly for selective engagement with the control tracks to achieve either continued travel in the first direction or switched travel in the second direction.

Various modifications may be made in the monorail construction and in the vehicle design.

The switch layering may be modified so that the 'down' position of the struts result in the car taking the right or curved path, and the 'up' position of the struts result in the car taking the left or straight path. The way to do this would be to interchange monorail control track layers, and the position of the required strut and wheel gaps. The top layer would remain the same.

Other possible variations include changing the detailed makeup of the car frame and strut frame. Two single, wider wheels can replace the four center wheels. The wheels can be solid steel, a mixture of steel and polymer, have a polyurethane tire, or be pneumatic. The position along the track (fore and rear) position of the side wheels relative to the center wheels may be chanced.

The number of actuators (70) can be varied, as can be the number of springs.

Two or more of the center wheels can be powered by motors to propel the car along the track. The car may instead be pulled along the track by a grip and cable system, if the grip can change cables at switch locations.

Different width switching wheels can be used top and bottom. Wider wheels may be better to use at the top because of the larger reactions on these wheels than the bottom wheels.

Track materials can include structural steel or aluminum, wood, plastic, or other polymer, or composite material; practically any structural material may be used. As indicated above, track layer 6*g* may be made thinner than the other layers to minimize centripetal forces. The lateral stabilizing rails and rail extensions present in the designs may be adjusted or eliminated.

The vehicle may be modified in several ways and still use the same general mechanism. These variations are presented since the mechanism of moving the wheels vertically may be most economically done in different ways for different sizes of track and different uses of the system.

Figure 23:
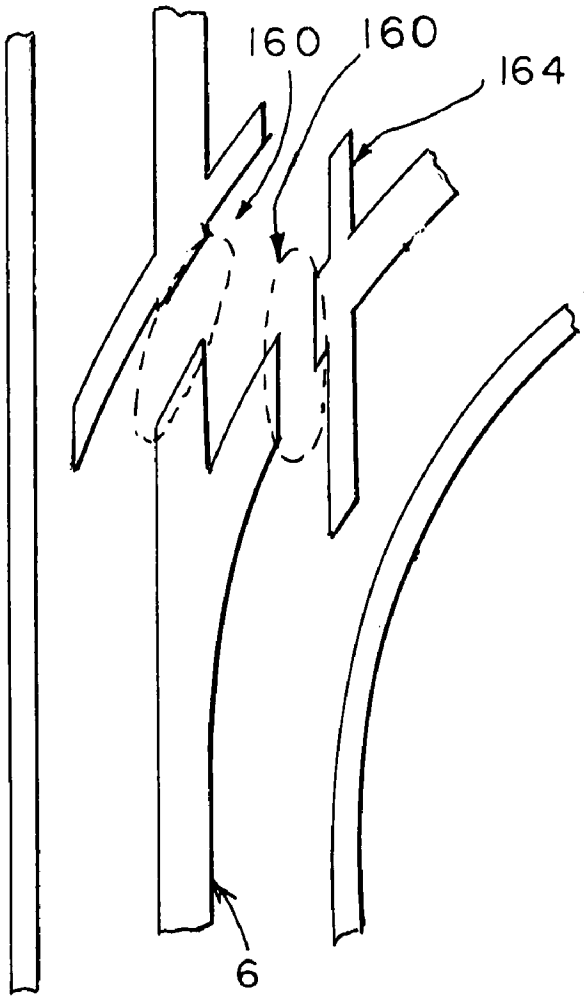

In the case of the upper strut sections being outboard of the lower strut sections as in FIG. 20, the seventh layer of track needs to be configured as shown in FIG. 23. The principal differences are that the strut gaps 160 are outboard of where they were in FIG. 12 and rail extensions 164 are configured for the wider separation of the upper strut sections.

Figure 24:
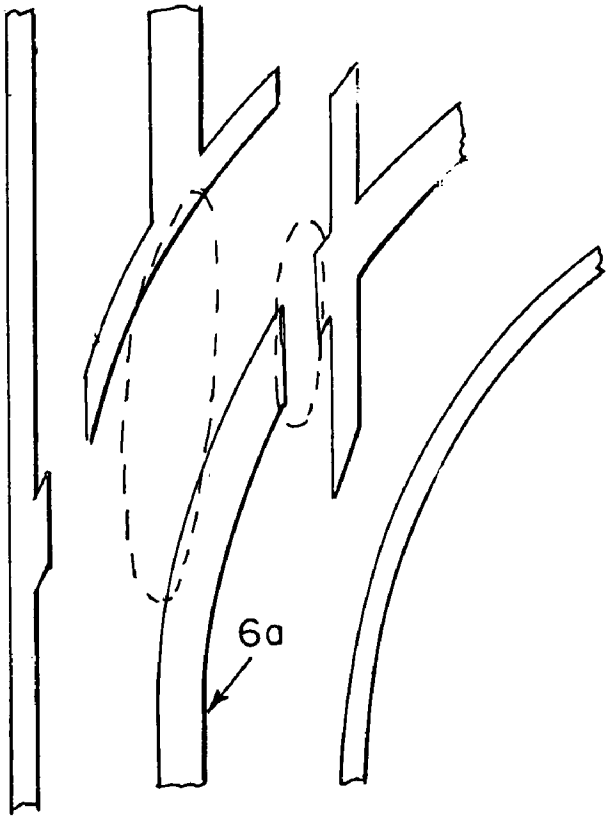
FIGS. 23 and 24 illustrate another embodiment of the switching rail layers of the invention.

The modified layer 6*f* of the track is configured as shown in FIG. 24, with the rails 50 and wheel gap 162, as shown.

Figure 26:
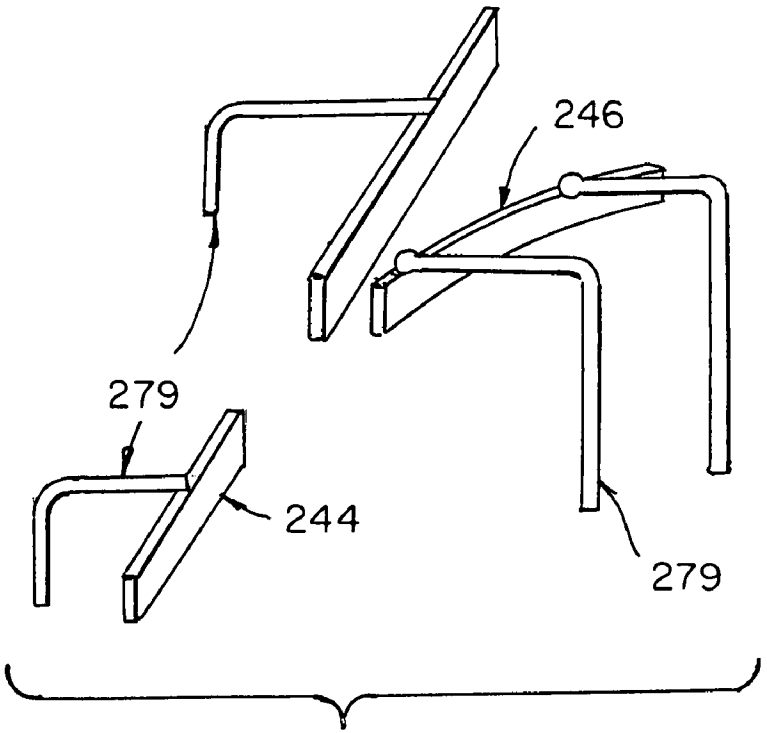
FIG. 26 is a perspective view of the stabilizing means of FIG. 25.
Figure 25:
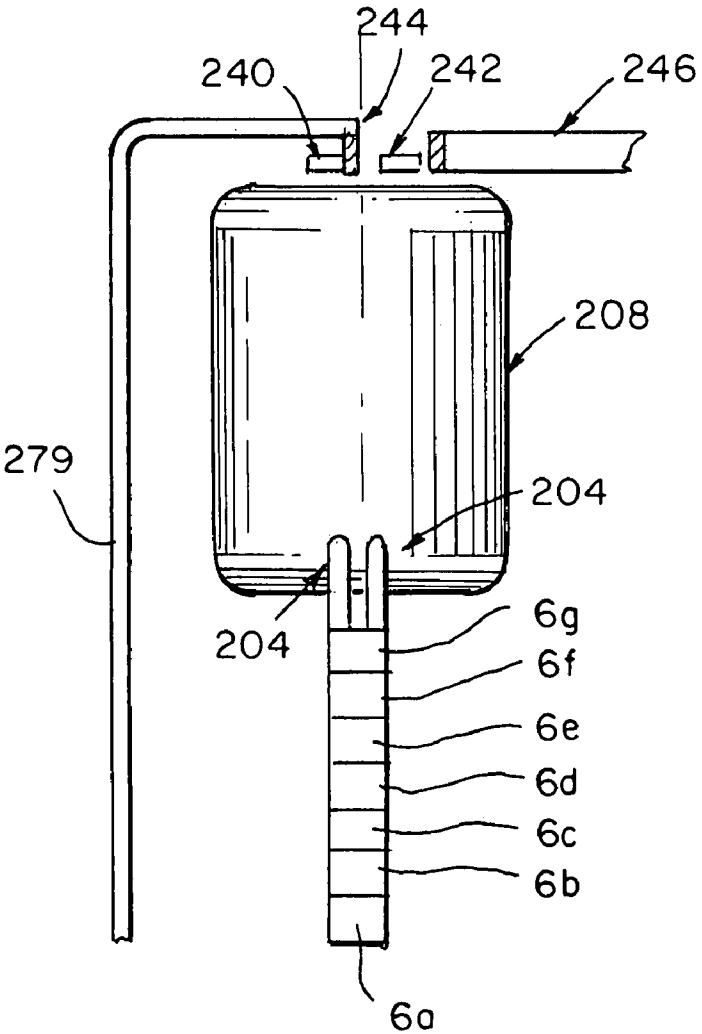
FIG. 25 is a sectional representation of a further modification of the stabilizing means of the invention.

In the embodiment of FIGS. 25 and 26, the wing wheels 240 and 242 arranged at the top of the vehicle 208 for engagement with the stabilizing rails 244 and 246, respectively. The rails are supported by the vertical supports 279.

Note that the right upper rail has to begin at a position along the track that allows the right par of wing wheels to clear it in case the left or straight path is taken. The left upper rail sections separated so that the left pair of wing wheels have clearance in case the right or turning path is taken. The gap in the upper rails is negotiated before the support wheels negotiate the strut gaps in the top layer of the monorail.

While in accordance with the provisions of the Patent Statutes the preferred forms and embodiments of the invention have been illustrated and described, it will be apparent to those skilled in the art that various changes and modifications may be made without deviating from the inventive concepts set forth above.

What is claimed is:

1. A monorail switching arrangement for controlling the direction of switching of a vehicle along a monorail system, comprising:

(a) a generally horizontal sectional monorail system including:

(1) a plurality of coplanar monorail sections each having a rectangular cross-section and including horizontal top and bottom surfaces; and a pair of vertical side wall surfaces;

(2) a first one of said monorail sections being an initial travel section, a second one of said sections comprising a continued travel section arranged in slightly spaced collinear relation adjacent one end of said first section, and a third one of said sections comprising a switching section arranged in spaced relation adjacent said first section one end and angularly arranged relative to the longitudinal axis of said travel section;

(b) a vehicle supported for longitudinal travel along said first monorail section, said vehicle including:

(1) a chassis; and (2) a plurality of vertically arranged support wheels rotatably connected with said chassis for engagement with the top surface of said monorail travel section; and (c) switching means for alternately switching said vehicle for travel from said first monorail section to a selected one of said second and third sections, respectively, said switching means comprising:

(1) a first pair of continued-travel control tracks arranged at a first elevation on opposite sides of said first monorail section;

(2) a first pair of switched-travel control tracks arranged at a second elevation on opposite sides of said travel monorail section;

(3) a first pair of horizontally arranged switching wheels arranged on opposite sides of said travel monorail section;

(4) switching wheel connecting means for connecting said switching wheels with said chassis; and (5) selecting means for varying the elevation of said first pair of switching wheels between a first elevated position in engagement, with said continued-travel control tracks, respectively, and a second elevated position in engagement with said switched-travel control tracks, respectively, thereby to control the switching direction of the vehicle.

2. A monorail switching arrangement as defined in claim 1, wherein said first monorail section consists of a vertical stack of horizontal control layers at least a first one of which carries said continued-travel control tracks, and a second one of which carries said switched-travel control tracks, said first monorail section further including a support layer supporting said first and second control layers.

3. A monorail switching arrangement as defined in claim 2, wherein said vertical support wheels support said chassis at a fixed height above the upper surface of said first monorail section; wherein said connecting means connects said switching wheels for vertical displacement relative to said vehicle chassis; and further wherein said selecting means is operable to vertically displace said switching wheels relative to said vehicle chassis between said first and second positions.

4. A monorail switching arrangement as defined in claim 2, wherein said switching wheels are carried at a fixed height relative to said vehicle chassis; and further wherein said selecting means is operable to vary the elevation of said vehicle chassis relative to said support wheels, thereby to vary the elevation of said switching wheels between said first and second positions, respectively.

5. A monorail switching arrangement as defined in claim 3, wherein said connecting means comprises a switching frame connected for vertical movement relative to said vehicle chassis.

6. A monorail switching arrangement as defined in claim 5, wherein said switching means further includes:

(6) a second pair of horizontally arranged switching wheels connected with said switching frame in coplanar relation relative to said first pair of switching wheels, said second pair of switching wheels being arranged in longitudinally spaced relation relative to said first pair of switching wheels on opposite sides of said first monorail section for selective engagement with said continued travel control tracks and said switching control tracks, respectively.

7. A monorail switching arrangement as defined in claim 6, wherein said switching means further includes:

(7) third and fourth pairs of horizontally arranged switching wheels contained in a horizontal plane at a higher elevation than the plane containing said first and second pairs of switching wheels, said third and fourth pairs of switching wheels being arranged directly above said first and second pairs of switching wheels on opposite sides of said first monorail section, respectively;

(8) said switching means including second pairs of continued-travel and switched-travel control tracks arranged on opposite sides of third and fourth control layers of said first monorail section in horizontal planes above said continued travel and switched-travel control tracks, respectively, said second pairs of continued-travel and switched-travel control tracks being arranged for engagement by said third and fourth pairs of switching wheels when said first and second switching wheels are in their first and second elevated positions, respectively.

8. A monorail switching arrangement as defined in claim 7, wherein said first monorail section includes a space layer mounted on said second control layer for supporting said third and fourth control layers.

9. A monorail switching arrangement as defined in claim 8, wherein said switching frame includes vertical and horizontal struts supporting said switching wheels; and further wherein at least some of said monorail layers contain first and second gaps through which said frame vertical struts and said switching wheels respectively pass during travel of the vehicle along the monorail first section.

10. A monorail switching system as defined in claim 9, and further including:

(d) at least one pair of vertically arranged wing wheels connected with said vehicle chassis on opposite sides thereof, said wing wheels being contained in vertical planes parallel with and outboard of said support wheels; and (e) a pair of fixed horizontal support rails arranged on opposite sides of said monorail, said lateral support rails having upper horizontal surfaces arranged to support said wing wheels, respectively, thereby to provide lateral support of the vehicle during the switching operation thereof.

11. A monorail switching arrangement as defined in claim 10, and further including:

(f) fixed stanchion means supporting said lateral support rails such that the upper support surfaces thereof are generally coplanar with the horizontal top surface of said first monorail section.

12. A monorail switching arrangement as defined in claims 11, wherein said first monorail section includes a third support layer mounted on said second switching track layer, the upper surface of said third support rail defining the top surface of said first monorail section.

13. A monorail switching system as defined in claim 4, wherein said vehicle further includes:

(3) pivot arm means pivotally connecting said support wheels for vertical movement relative to said vehicle chassis;

and further wherein said selecting means includes motor means for operating said pivot arm means to raise and lower said vehicle chassis relative to said first monorail section.

14. A monorail switching system as defined in claim 13, wherein said motor means comprise a plurality of jack screws.

15. A monorail switching system as defined in claim 13, wherein said motor means comprises a plurality of piston and cylinder hydraulic motors.

16. A monorail switching system as defined in claim 13, wherein said pivot arm means includes a four-bar linkage arrangement for raising and lowering the vehicle chassis relative to said support wheels and the first monorail horizontal top support surface.

17. A monorail switching system as defined in claim 4, and further including stabilizing means for stabilizing the vehicle during the travel thereof along the first monorail section, said stabilizing means including horizontal wing wheels connected with the upper surface of the vehicle for rotation about vertical axes, respectively, and fixed stabilizing rails arranged in spaced relation above said first monorail for engagement by said wing wheels.

* * * * *